United States Patent [19]

Carlin et al.

[11] 4,304,302

[45] Dec. 8, 1981

[54] METHOD FOR INJECTING A TWO PHASE FLUID INTO A SUBTERRANEAN RESERVOIR

[75] Inventors: Joseph T. Carlin; Richard H. Widmyer; Robert G. Pindell, all of Houston, Tex.

[73] Assignee: Texaco Inc., White Plains, N.Y.

[21] Appl. No.: 88,903

[22] Filed: Oct. 29, 1979

[51] Int. Cl.[3] ..... E21B 43/20; E21B 43/24

[52] U.S. Cl. ..... 166/303; 166/268; 166/272; 166/305 R

[58] Field of Search ..... 175/69, 71; 166/52, 166/268, 274, 269, 272, 305 R, 303, 309; 299/4, 5

[56] References Cited

U.S. PATENT DOCUMENTS

| | | | |
|---|---|---|---|
| 1,886,886 | 11/1932 | Kelley et al. | 166/303 X |
| 2,953,204 | 9/1960 | Doscher et al. | 166/268 X |
| 2,998,066 | 8/1961 | Nixon, Sr. | 166/305 R |
| 3,100,528 | 8/1963 | Plummer et al. | 166/309 X |
| 3,170,513 | 2/1965 | Dew et al. | 166/274 |
| 3,186,484 | 6/1965 | Waterman | 166/272 X |
| 3,344,856 | 10/1967 | Lange | 166/269 X |
| 3,493,059 | 2/1970 | Cox | 175/69 X |
| 3,730,273 | 5/1973 | Wilson | 166/305 R X |
| 3,782,470 | 1/1974 | West et al. | 166/303 |
| 3,838,737 | 10/1974 | Allen et al. | 166/274 X |
| 3,861,469 | 1/1975 | Bayless et al. | 166/303 |
| 3,980,137 | 9/1976 | Gray | 166/272 X |
| 3,993,130 | 11/1976 | Papp | 166/305 R X |
| 4,034,810 | 7/1977 | Holloway | 166/274 |
| 4,058,164 | 11/1977 | Stoddard et al. | 166/303 |

*Primary Examiner*—Stephen J. Novosad
*Assistant Examiner*—George A. Suchfield
*Attorney, Agent, or Firm*—Carl G. Ries; Robert A. Kulason; Jack H. Park

[57] ABSTRACT

In a method wherein valuable substances are recovered from a subterranean reservoir comprising the injection of a two phase fluid into the reservoir, uniform injectivity of the two separate phases is achieved by conducting the injected fluid to a point below the bottom of the injection interval in the well bore of the injection well through a tubing to which is attached a terminal device which is penetrated by a plurality of holes, each such hole being of sufficient diameter to reduce the bubble size of the gas phase to less than about 0.5 inches.

9 Claims, 3 Drawing Figures

METHOD FOR INJECTING A TWO PHASE FLUID INTO A SUBTERRANEAN RESERVOIR

BACKGROUND OF THE INVENTION

1. Field of the Invention

This invention relates to an improved method for injecting a two phase fluid through an injection well into subterranean formation.

2. Description of the Prior Art

The injection of a two phase fluid as a step in methods for the recovery of valuable substances from subsurface earth formations has seen increasingly wide use in recent years. Such fluids are perhaps most commonly utilized in the course of recovery processes involving the extraction of hydrocarbons from subterranean reservoirs. Probably the most widely used and most successful of these processes is steam injection wherein the injected steam contains both liquid and vapor water phases. Other commonly used two phase injection fluids useful in petroleum recovery operations are hydrocarbon gas and water mixtures, carbon dioxide and water mixtures, and air and water mixtures to name a few. Steam flooding, carbon dioxide flooding, in situ combustion, and repressurization are all techniques that commonly will employ the injection of a two phase fluid into a subterranean reservoir in order to recover additional quantities of petroleum therefrom. The injection of a two phase fluid is not a process limited solely to petroleum recovery operations, however. It can be utilized in the course of oil shale in situ retort operations, as well as in the leaching of mineral values from subsurface earth formations such as in uranium leaching processes.

Regardless of the specific gas and liquid phases employed or the particular process used, the injection of a two phase fluid is hot without problems, the chief of which is the tendency of the less dense vapor phase to rise to the upper portion of a given vertical injection interval. Another problem concerns the tendency of the gas bubbles to coalesce into larger bubbles which tend to disrupt the entry of uniform proportions of each phase into the formation at any given point along the injection interval. The vertical segregation of the gas phase becomes a problem whenever the bubble rise velocity exceeds the velocity of the fluid as a whole as it is injected downward into the injection interval. One solution has been to inject the fluid at such a rate that the downward velocity of the fluid will always exceed the bubble rise velocity over the entire length of the injection interval. This, however, becomes impracticable and often impossible for injection intervals longer than a few feet in depth. Another solution has been to separate the two phases, injecting the gas phase at the bottom of the injection interval and the liquid phase at the top of the interval. By this method a majority of the gas phase can be induced to enter the lower portion of the injection interval, while the liquid phase enters predominantly into the upper portion of the interval. However, this method requires separate metering and injecting systems for both phases with the associated need for a higher level of supervision and greater expense.

It can be readily seen that there remains a substantial need for a method which provides for the uniform injection of a two phase fluid over an injection interval in a subsurface earth formation.

SUMMARY OF THE INVENTION

In a process for the recovery of valuable materials from a subsurface earth formation, one step of which comprises the injection of a two phase fluid through an injection well into an injection interval within the subsurface earth formation, the injected fluid is conducted to a point below the bottom of the injection interval through a tubing to which is attached a terminal device which is penetrated by a plurality of holes, each such hole being of sufficient diameter to reduce the bubble size of the gas phase to less than about 0.5 inches.

DESCRIPTION OF THE PREFERRED EMBODIMENTS

Figure 1:
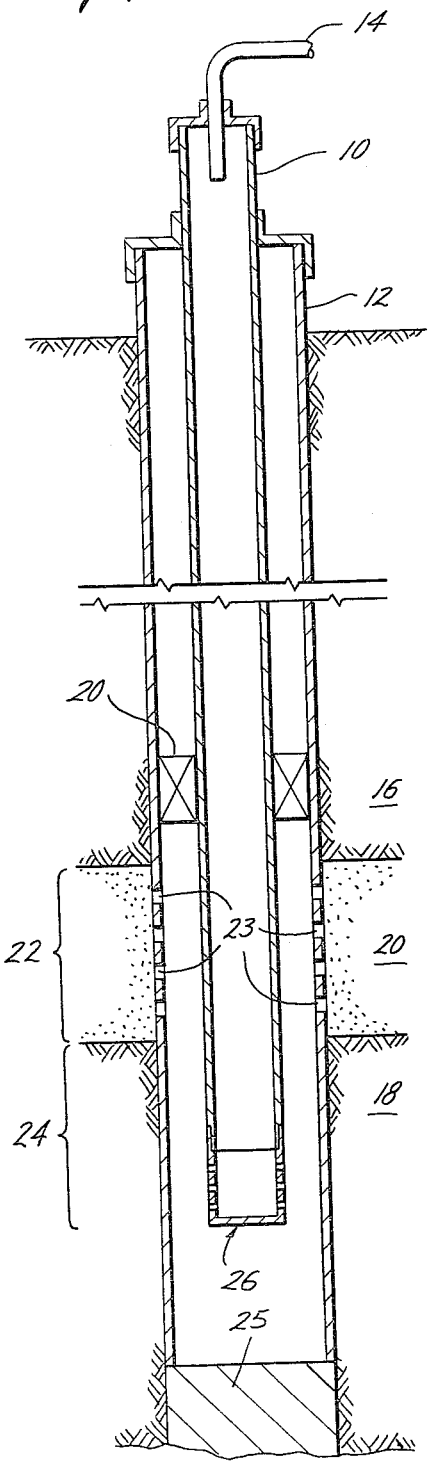
FIG. 1 shows a cross sectional view of the entire injection well assembly.

Two main problems are associated with the injection of a two phase fluid into an injection interval within a subsurface earth formation through an injection well. One is the tendency of the gas phase to segregate itself into the upper portion of the injection interval due to its lesser density when compared to the liquid phase. The second problem concerns the tendency of the gas bubbles within the fluid stream to coalesce into much larger gas bubbles which are not conducive to efficient fluid injection into the formation. In this invention the problem of the coalescence of the gas bubbles within the fluid stream into larger bubble sizes is prevented by passing the fluid stream, which has been conducted downwards from the surface through a tubing, out through a terminal device which is penetrated by a plurality of holes. The diameter of these holes is such that the bubble size of the gas phase of the fluid upon exit from the holes is less than 0.5 inches. In order to obtain optimum homogeneity of the two phase fluid and the resulting uniformity of injectivity into the formation, it is desirable to make the bubble size of the gas phase as small as possible. However, practical considerations place a limit on the minimum size of the gas bubbles, and it has been found that bubble sizes in the range from about 0.25 to about 0.50 inches result in gas-liquid fluid mixtures that exhibit acceptable fluid flow properties. To this end, the terminal device contains a plurality of holes, each such hole being of the size less than about 0.5 inches through which the injected fluid is forced. Passing the fluid through these holes results in the desired bubble size in the fluid. In order to maintain an acceptable injection rate, the total flow area through the holes should range in area from about one to about two times the flow area of the tubing. One preferred hole diameter is about 0.375 inches. In one preferred configuration, the plurality of holes is arrayed in two or more concentric bands around the terminal device, each such band comprising a plurality of equally spaced apart holes, the holes in each band being offset from the holes of the band immediately above or below.

This invention confronts the problem of vertical segregation of the gas phase by introducing the injected fluid to the well bore at a point below the injection interval into the formation. Unlike the situation wherein the injected fluid is introduced into the well bore at or above the top of the injection interval with the result that the gas phase will not descend to a point below which the bubble rise velocity exceeds the downward injection velocity of the fluid, by introducing the injected fluid at a point below the injection interval the formation will be exposed to a uniform mixture of gas and liquid phases over the entire injection interval, since both the bubble rise velocity vector and the injected fluid velocity vectors are directed upward instead of in opposite directions as in the previous case. One preferred position for the terminal device is at a point about five feet below the bottom of the injection interval.

This method is intended to be employed using a two phase fluid wherein the liquid phase is the continuous phase. A wide range of injection rates can be utilized in the practice of this invention, and the selection thereof can be left to the experienced practitioner in the field.

Reference is now made to the following two examples in which two specific embodiments of this invention are described in conjunction with the figures.

EXAMPLE 1

This example will illustrate the practice of the invention in a typical oil recovery process in which a two phase fluid mixture composed of 30 percent by mass natural gas and 70 percent by mass water is injected into a subterranean formation. Reference is made to FIG. 1 to describe the specific procedures involved in one embodiment of the practice of this invention. The two phase fluid is conducted through appropriate means (14) into the tubing (10) at the surface location of the injection well. The two phase fluid is then conducted downwards through the tubing 10 to a point a certain distance (24), here five feet, below the bottom of the formation of interest (20) which contains a hydrocarbon deposit. This formation (20) is a porous sandstone which lies between two non-porous shale formations (16 and 28) immediately above and below the sandstone formation (20). The injection well contains a casing (12) which extends from the surface to a point below the bottom of the tubing string (10). An injection interval (22) has been established in the vicinity of the sandstone formation (20) by making a plurality of perforations (23) enabling fluid communication from the injection well into the sandstone formation (20). The annulus region between the outside of the tubing (10) and the inside of the casing (12) is sealed at a point immediately above the sandstone formation (20) by a packer (28). The injection well is sealed off at a point below the bottom of the tubing (10) by a cement plug (25).

The two phase fluid is then conducted downwards through the tubing (10) to a point below the bottom of the injection interval (22) where it exits the tubing (10) through a terminal device (26) which is attached to the bottom of the tubing string and is perforated by two or more bands of holes arrayed regularly around the circumference of the device. Passage of the two phase fluid through the holes in the device (26) creates a relatively homogeneous mixture of efficiently sized gas bubbles and water which flows upwards from the device (26) into the annulus from which it then enters the injection interval (22) and then passes through the perforations (23) into the formation (20), wherein the homogeneous gas-liquid mixture plays its part in the normal sequence of steps in the oil recovery process as a whole.

Figure 1A:
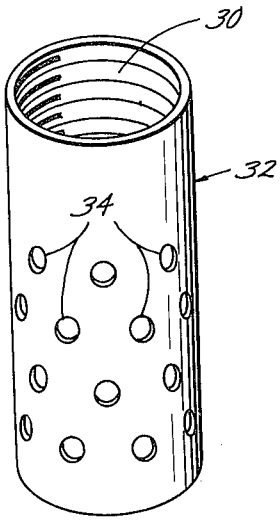
FIGS. 1A and 1B show isometric views of two particular configuration of the terminal device.

One preferred embodiment of the perforated device (26) attached to the bottom of the tubing strain in FIG. 1 is illustrated in more detail in FIG. 1A. This particular perforated device (32) is illustrated with threaded means (30) for attachment to the bottom of the tubing string (10). The device can, however, be an integral part of the bottom of the tubing string with the holes (34) being drilled directly into the bottom of the tubing with a plug being attached to the bottom end. In this particular embodiment, the diameter of the device is the same as the diameter of tubing at the bottom of the tubing string (10). The device is closed at the bottom. A plurality of holes extends from the inside to the outside of the device. The holes are arrayed in such a manner as to insure maximum homogeneity of the gas-liquid mixture as it is pumped out through the holes into the injection well annulus. In one preferred embodiment, the holes are arrayed in two or more circumferential bands, each band containing from about five to about ten evenly spaced holes. The holes in each band should be offset from the holes in the band immediately above or below it. The size of each hole is preferably the same and should be less than about 0.5 inches and is preferably about 0.375 inches. The total flow area through the holes should be from about one to about two times the total flow area through the tubing at the bottom of the tubing string (10). For $2\frac{3}{8}$ inch OD tubing, a pattern of six bands of three-eighths inch holes with seven holes per band is adequate; for $2\frac{7}{8}$ inch OD tubing, a pattern of eight bands of holes with eight holes per band is likewise adequate. The vertical spacing in between the bands of holes should be from about two to about ten hole-diameters and is preferably about four to five hole-diameters.

EXAMPLE 2

Figure 1B:
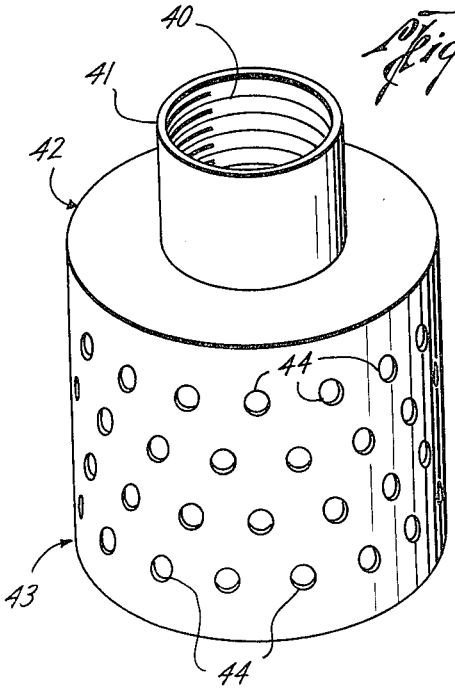

In this example the method and apparatus employed are identical to the previous example, except for the configuration of the perforated device attached to the bottom of the tubing string. FIG. 1B portrays a preferred embodiment of this perforated device. This device (42) comprises an upper portion (41) which is of the same diameter as the tubing at the bottom of the tubing string. This upper portion also contains means here illustrated as a threaded connection (40) for attachment of the device (42) to the bottom of the tubing string. The lower portion of the device (43) is of a diameter greater than the upper portion of the device (41), yet still small enough to pass readily through the casing and/or any other up-hole obstructions through which the device must pass during its implacement into the injection well. The lower part of the device (43) contains the plurality of holes (44). As in Example 1, the holes are preferably of the size less than about 0.5 inches and more preferably about 0.375 inches in diameter, and the total flow area of the holes should be from about one to about two times the flow area of the tubing at the bottom of the tubing string. In this configuration, since the circumference of the lower portion of the device (43) is greater than the corresponding circumference in Example 1, more holes may be implaced in each band with a consequent reduction in the required number of bands. This in turn has the desirable effect of reducing the opportunity for bubble recombination in the fluid as it exits the device (42). Another advantage to this configuration is that the bubbles are generated nearer the casing wall where they may more readily be introduced through the perforations into the subject formation.

The above described examples, figures and configurations are presented for the purpose of illustration of the practice of the method of this invention and should not be considered as limitative. Further modifications will be apparent to those skilled in the art. Such modifications are included within the scope of this invention as defined by the following claims.

We claim:

1. In an enhanced oil recovery method for the recovery of hydrocarbons contained within subsurface earth formations wherein a two phase fluid comprising a liquid phase and a gaseous phase is injected into an injection interval in the formation through an injection well, the improvement wherein the injected fluid is conducted to a point below the bottom of the injection interval in the well bore through a tubing to which is attached a device which is penetrated by a plurality of holes, each such hole being of sufficient diameter to reduce the bubble size of the gas phase of the fluid to less than about 0.5 inches.

2. The method of claim 1 wherein the flow area through the plurality of holes in the device ranges from about one to about two times the flow area of the tubing to which it is attached.

3. The method of claim 1 wherein the device is located at a point about five feet below the bottom of the injection interval in the injection well.

4. The method of claim 1 wherein the device further comprises:

(a) means for coupling the device to the tubing, (b) a cylindrical body wherein the body is pierced by a plurality of holes oriented uniformly about the body in a manner designed to insure maximum homogeneity of the two-phase fluid as it is pumped out through the holes of the device, and (c) capping means permanently closing off the end of the body opposite the coupling means.

5. The method of claim 4 wherein the diameter of the device attached to the tubing is approximately the same as the diameter of the tubing.

6. The method of claim 4 wherein the capping means is penetrated by a plurality of holes, said holes being of the same diameter as those in the body of the device.

7. The method of claim 4 wherein the holes in the body are arranged in at least two rings about the circumference of the device wherein the holes in each ring are offset from the holes of the rings immediately above or below and wherein the rings are spaced at least three hole diameters apart.

8. The method as recited in claim 1 wherein the two phase fluid injected into the formation comprises steam.

9. The method of claim 1 wherein the two phase fluid comprises a mixture of water and natural gas.

* * * * *